United States Patent [19]

De Filippi

[11] Patent Number: 4,726,281

[45] Date of Patent: Feb. 23, 1988

[54] HYDRAULIC CYLINDER

[76] Inventor: Quinto De Filippi, 29 Edenvalley Dr., Islington, Ontario, Canada

[21] Appl. No.: 874,135

[22] Filed: Jun. 13, 1986

[51] Int. Cl.[4] ..... F15B 11/16

[52] U.S. Cl. ..... 91/167 R; 92/52; 92/53

[58] Field of Search ..... 92/52, 53; 91/167 R; 137/355.17, 355.24

[56] References Cited

U.S. PATENT DOCUMENTS

| | | | |
|---|---|---|---|
| 2,933,070 | 4/1960 | Trumper | 92/530 X |
| 3,190,307 | 6/1965 | DeVries | 137/355.17 |
| 3,696,712 | 10/1972 | Sung | 92/52 |
| 3,823,937 | 9/1974 | Moore | 91/167 R |
| 4,380,244 | 4/1983 | Caudill | 137/353.17 X |

*Primary Examiner*—Alan Cohan

*Attorney, Agent, or Firm*—George A. Rolston

[57] ABSTRACT

A multistage cylinder having a partial force mode, a full force extended mode, and a full force retracted mode, and having an outer cylinder closed at one end and open at the other, one or more intermediate cylinders located within the outer cylinder, and extendable and retractable with respect thereto, an inner drive member within the intermediate cylinder, and extendable and retractable with respect thereto, intermediate hydraulic fluid conduits in the drive member for flow of hydraulic fluid and from the intermediate cylinder, and an intermediate valve for controlling flow of fluid thereto, outer cylindrical hydraulic fluid supply and return conduits connecting directly with an outer cylinder, separate from the intermediate conduits, and an outer cylinder valve for controlling flow of fluid independent of the intermediate cylinder and a fluid flow barrier between the intermediate cylinder and the outer cylinder so that fluid from the intermediate cylinder is maintained out of contact with the outer cylinder.

3 Claims, 5 Drawing Figures

HYDRAULIC CYLINDER

The invention relates to multistage hydraulic cylinders of the type in which a plurality of cylinders and pistons telescope within each other.

BACKGROUND OF THE INVENTION

In a multistage cylinder a plurality of cylinders, and pistons, are arranged in a telescopic manner one within the other. Piston rings seal between each of the cylinders, and internal ports permit oil to flow for either extending or retracting the cylinders one within each other.

The free end of the outer or largest cylinder is adapted to be connected for performing work, and the free end of the smallest innermost cylinder is also adapted to be connected for doing work.

Oil may be supplied either through the largest cylinder, or along the axis of the smallest cylinder. Hydraulic fluid will thus cause all of the cylinders to be extended one from the other during a work stroke.

An inherent disadvantage of such multistage cylinders is the fact that the maximum force that can be exerted at a given pressure is controlled by the area of the piston on the smallest cylinder. It is of course well understood that the force exerted by any cylinder is determined by the pressure of the fluid, and the area of the piston.

Since in this type of cylinder all pistons work simultaneously, the maximum force that is available, is a product of the diameter of the smallest piston. It is, of course, well known that the volume of hydraulic fluid required to extend such of multistage cylinders is the product of the volumes of all of the cylinders. Consequently, very large volumes of fluid are required to fully extend multistage cylinders, and relatively high fluid pressures are required so as to obtain adequate force, for the purpose intended, from the relatively small piston area.

As a result, such multistage cylinders are relatively inefficient in terms of power consumption.

In many applications such as, for example, packing of refuse in a refuse container, where for example the cylinder may not always be used at full extension, the operation of all stages of the cylinder simultaneously for packing refuse will require very substantial fluid flows into and out of the cylinder for each packing and retraction cycle, where only a modest force is required. Full force will not be required until the cylinder is used to actually compact or wedge the refuse into a smaller space. Clearly, it would also be desirable to reduce the volume of fluid required for operating the cylinder during this stage of operation.

Secondly, it would be desirable if the largest diameter cylinder and piston could be operated independently so as to develop the full force available from the fluid over the entire area of the largest piston.

BRIEF SUMMARY OF THE INVENTION

With a view to overcoming these various problems and to achieving the advantages decribed, the invention comprises a multistage cylinder having three modes of operation, namely a partial force mode, a full force extended mode, and a full force retracted mode, and comprising an outer cylinder, intermediate cylinder means located within said outer cylinder, and extendable and retractable with respect thereto, an inner drive member located within said intermediate cylinder means, and extendable and retractable with respect thereto, piston means on said intermediate cylinder means, and on said drive member cylinder end closure means on said outer cylinder and said intermediate cylinder means, intermediate hydraulic fluid supply means in said drive member for supplying hydraulic fluid to said intermediate cylinder means, and fluid return means in said drive member for returning said fluid therefrom, valve means and conduit means connected with said intermediate supply and return means, for controlling flow of fluid with respect thereto, outer cylinder hydraulic fluid supply means, and fluid return means, connecting directly with said outer cylinder, and valve means connected thereto for controlling supply and return of fluid from said outer cylinder, and partition means between said intermediate cylinder means and said outer cylinder constituting a fluid flow barrier therebetween whereby fluid from said intermediate supply means in maintained out of contact with said outer cylinder.

More particularly, it is an objective of the invention to provide multistage cylinders having the foregoing advantages wherein said intermediate cylinder means comprises at least one larger and one smaller intermediate cylinder, the smaller intermediate cylinder being extendable and retractable with respect to the larger intermediate cylinder, and said larger intermediate cylinder being extendable and retractable within said outer cylinder, and said drive member being extendable and retractable within said smaller intermediate cylinder, and including piston means on both said intermediate cylinders, and cylinder closure means on both said intermediate cylinders, and said partition means being formed adjacent said piston means on said larger intermediate cylinder.

More particularly, it is an objective of the invention to provide a multistage cylinder having the foregoing advantages including fluid inlet conduit means in said drive member and fluid outlet conduit means in said drive member separate from said fluid inlet conduit means, and including fluid communication passageways in said drive member, and in said smaller intermediate cylinder, for communicating passage of fluid therebetween.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
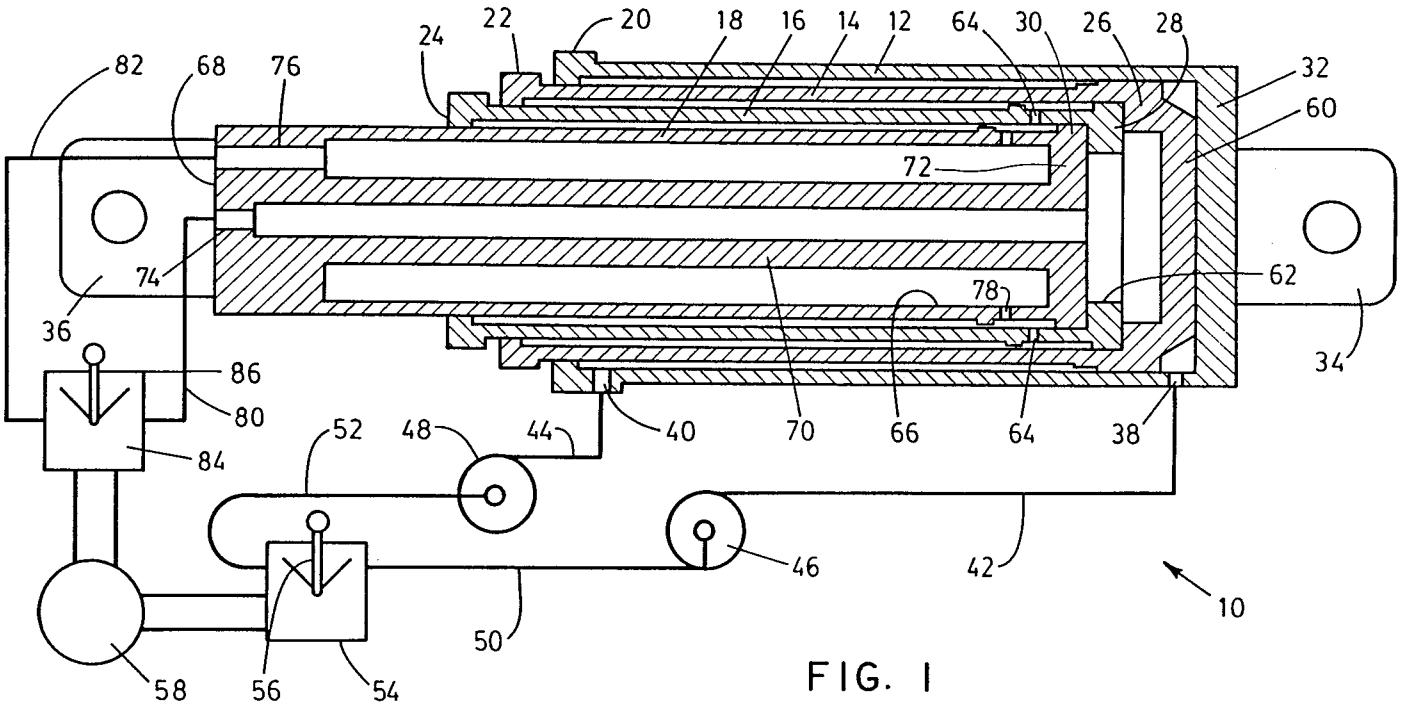
FIG. 1 is a schematic sectional side elevation of a set of multistage cylinders in accordance with the invention, together with a schematic fluid supply and return diagram.
Figure 2:
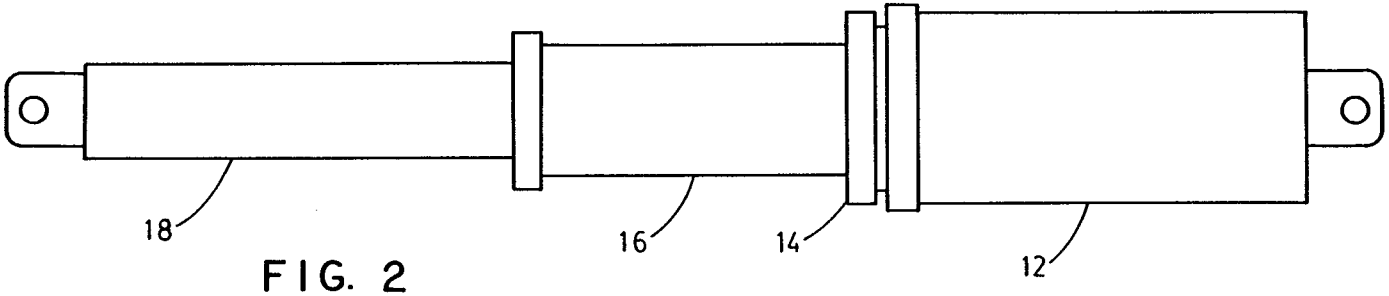
FIG. 2 is a schematic side elevation of the multistage cylinders of FIG. 1 showing the separate cylinders in a first mode of operation.
Figure 3:
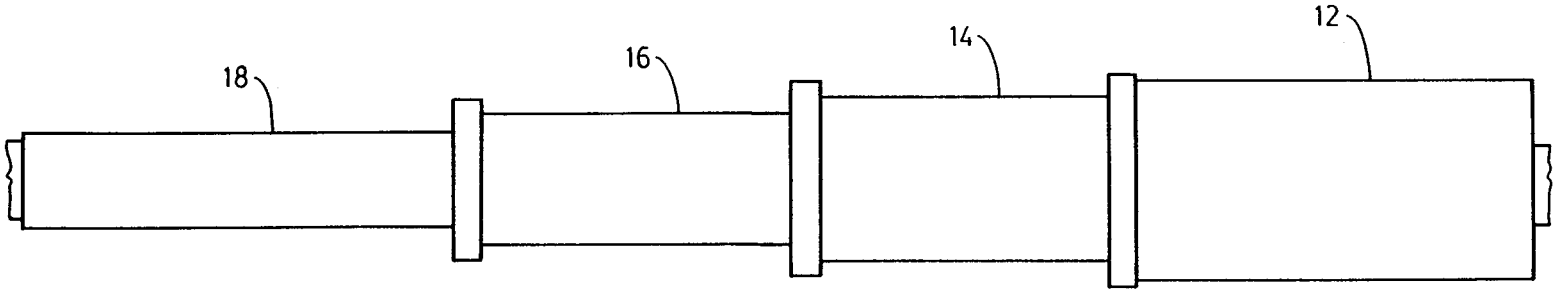
FIG. 3 is a schematic side elevation of the multistage cylinders of FIG. 1 showing the cylinders in another mode of operation.
Figure 4:
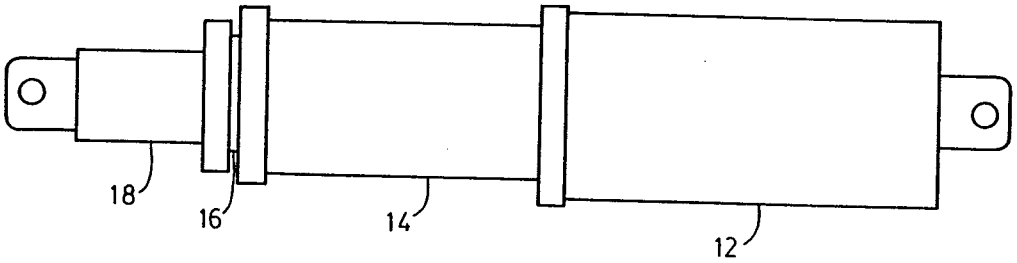
FIG. 4 is a schematic side elevation of the multistage cylinders of FIG. 1 showing the cylinders in a third mode of operation; and, FIG. 5 is a greatly enlarged partial section showing details of a typical cylinders and piston.

Referring now to FIG. 1, it will be seen that the invention is illustrated in the form of a four-part set of multicylinders indicated generally as 10. The multicylinders 10 comprise in this embodiment four separate members, namely an outer cylinder 12, a larger intermediate cylinder 14, a smaller intermediate cylinder 16, and a drive member 18.

It will of course be appreciated that the illustration of a four member set is solely for explanatory purposes. Three to six, or even more such members can be used.

Cylinders 12, 14 and 16 have end closure rings 20, 22 and 24, each of which is provided with appropriate seals (not shown) for sealing with the member fitting within it.

Figure 5:
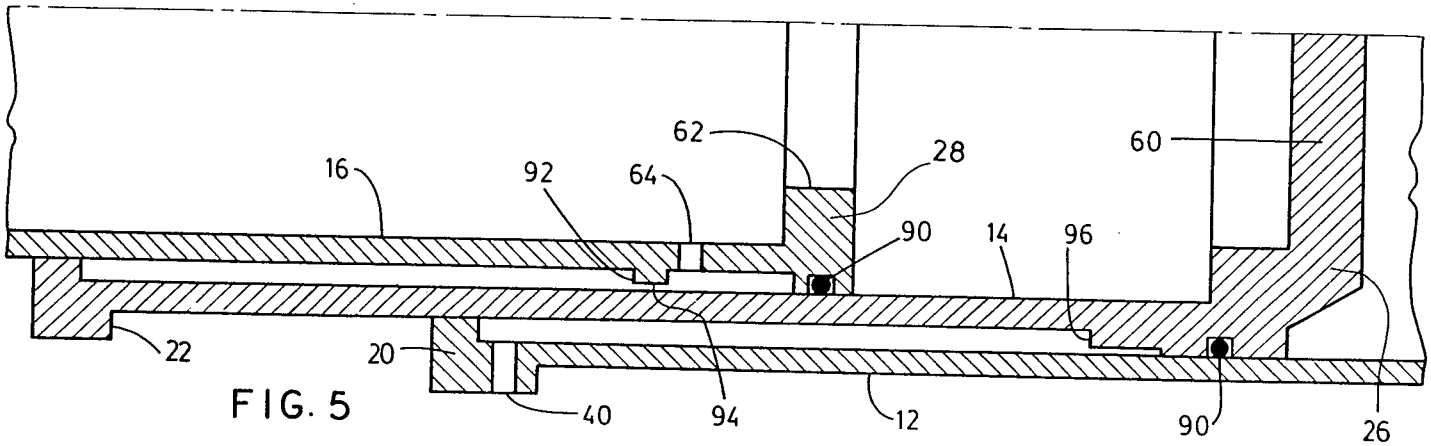

Cylinders 14 and 16 and drive member 18 are provided with pistons 26, 28 and 30, each of which is constructed essentially as shown in FIG. 5 and which will be described below.

Outer cylinder 20 has a closed end 32, to which is attached any suitable form of drive connector member 34.

Drive member 18 at its free end has a drive connector member 36 of any suitable design. By means of the connector members 34 and 36 the multistage cylinders 10 may be fastened or connected between a base member not shown and a movable member (not shown) by means of which the cylinder 10 may be operated to do useful work.

It will of course be appreciated that the details of such base member and movable member are omitted from the drawing for the sake of clarity, and may be of a very wide variety of types of structure or machinery, which form no part of the invention.

Outer cylinder 12 has two hydraulic fluid flow ports 38 and 40 adjacent its opposite ends, which are connected by flexible hydraulic hoses 42 and 44 to hose coiling devices 46 and 48. The hose coiling devices are adapted to be mounted at some suitable fixed location, such as an upper region of the interior of a refuse disposal vehicle (not shown).

The hoses at the hose coiling devices may be connected by either flexible or rigid hydraulic conduits 50 and 52, to a control valve 54. Control valve 54 is of the three position type, and will typically have a control handle 56, wherein the central vertical position corresponds to the valve being closed in both directions, and the right and left hand positions correspond to the opening of the valve in the corresponding direction, with return flow in the reverse direction. The valve is connected to a source of hydraulic pressurized fluid such as the pump 58.

The largest intermediate cylinder 14 has a front closure or partition member 60, adjacent the piston rings 26. In addition, it will be noted that cylinder 14 has no other communication ports formed in it for communication with the outer cylinder. Consequently, the outer cylinder is isolated from the largest intermediate cylinder, and hydraulic fluid flowing into either end of the outer cylinder will not be able to pass into the intermediate cylinder. Similarly hydraulic fluid in the intermediate cylinder will not be able to pass into the outer cylinder.

The smaller intermediate cylinder 16 has at its end adjacent its piston rings 28, a fluid flow passageway 62, allowing fluid flow between the smaller cylinder 16 and the larger intermediate cylinder 14.

Fluid flow sidewall ports 64 are also formed in cylinder 16 allowing fluid flow into and out of cylinder 14.

In this way hydraulic fluid can flow in both directions, on either side of the piston. The drive member 18, in this embodiment, is formed with a cylindrical outer wall 66, with the piston ring 30 formed on its front end, and with an end closure plate 68 on the rear or other end.

Within the hollow interior of the cylindrical sidewall 66, a central tubular conduit member 70 extends from one end to the other, passing through closure plate 72 at the front end of the drive member, and terminating at rear closure plate 68 at the rear end.

A fluid flow port 74 communicates with central conduit 70, through closure 68. A fluid flow port 76 passes through end closure 68 and communicates with the hollow interior of the cylindrical sidewall 66.

Drive member 18 is also provided with fluid flow openings or side wall ports 78 in the sidewall 66, communicating with the interior of the smaller intermediate cylinder 16.

It will thus be appreciated that hydraulic fluid flow may take place in either direction through the ports 74 and 76. Fluid flowing into and out of these ports will fill the cavity defined within the two intermediate cylinders 14 and 16, and the drive member.

However, this fluid will not be able to pass beyond the limits of the larger intermediate cylinder 14.

Hydraulic conduits 80 and 82 connect the ports 74 and 76 with a valve 84, which is in turn connected to the pump. The valve 84 has a handle 86, with three positions, similar to the valve already described.

Referring now to FIG. 5, the construction of each of the pistons 26, 28, and 30 is essentially as shown. Each piston will therefore comprise a sealing ring 90, and spaced rearwardly of the ring is a rearward stop portion 92, provided with a plurality of fluid passageways 94 therethrough.

Ring 90 and rearstop 92 are spaced apart from one another, and this space registers with the flow ports 64 in the cylinder wall.

In this way positive bottom stops are provided for positively stopping movement of each cylinder at the limit of its travel, while providing for hydraulic flow into and out of the cylinder on either side of the piston.

Larger intermediate cylinder 14 may have a bottom stop 96 adjacent its piston 26, since there are no sidewall openings in this cylinder.

What is claimed is:

1. A multistage cylinder apparatus having three modes of operation, namely a partial force mode, a full force extended mode, and a full force retracted mode, and comprising;

an outer cylinder having an inner surface with a first diameter and closed at a first end thereof and open at a second end thereof;

intermediate cylinder means having an outer surface with a second diameter smaller than said first diameter, an inner surface with a third diameter and located within said outer cylinder, and extendable and retractable with respect thereto, said inner surface of said outer cylinder and said outer surface of said intermediate cylinder means defining therebetween an outer annular space;

an inner drive member having an outer surface with a fourth diameter smaller than said third diameter and located within said intermediate cylinder means, and extendable and retractable with respect thereto, said inner surface of said intermediate cylinder means and said outer surface of said drive member defining therebetween an inner annular space;

outer cylinder piston means on said intermediate cylinder means;

intermediate piston means on said drive member;

end closure means on said outer cylinder in proximity to said open end thereof and terminally closing said outer annular space;

end closure means on said intermediate cylinder means and axially spaced apart thereon relative to said outer cylinder piston means and terminally closing said inner annular space;

first intermediate hydraulic fluid passage means in said drive member for supplying hydraulic fluid to said intermediate cylinder means to cause extension thereof and for the discharge of hydraulic fluid therefrom on retraction of said intermediate cylinder means;

second intermediate hydraulic fluid passage means in said drive member and communicating therethrough with said inner annular space for supplying hydraulic fluid thereto to cause retraction of said intermediate cylinder means and for the discharge of hydraulic fluid therefrom on extension of said intermediate cylinder means;

intermediate valve and conduit means connected with said first and second intermediate hydraulic fluid passage means for controlling the flow of fluid therefrom and thereto;

first outer cylinder hydraulic fluid passage means separate from said first and second intermediate hydraulic fluid passage means, for supplying hydraulic fluid to said outer cylinder to cause extension thereof and for the discharge of hydraulic fluid therefrom on retraction of said outer cylinder;

second outer cylinder hydraulic fluid passage means separate from said first and second intermediate hydraulic fluid passage means, communicating with said outer annular space for supplying hydraulic fluid thereto to cause retraction of said outer cylinder and for the discharge of hydraulic fluid therefrom on extension of said outer cylinder;

outer cylinder valve and conduit means separate from said intermediate valve and conduit means and connected with said first and second outer cylinder hydraulic fluid passage means for controlling the flow of fluid therefrom and thereto independently of operation of said intermediate cylinder means and, partition means between said intermediate cylinder means and said outer cylinder constituting a fluid flow barrier therebetween whereby fluid in said intermediate cylinder means is maintained out of contact with said outer cylinder and fluid in said outer cylinder is maintained out of contact with said intermediate cylinder means;

first abutment means on said outer surface of said drive member for abutment with said end closure means on said intermediate cylinder means on extension of said intermediate cylinder means relative to said drive member, said second intermediate fluid passage means being disposed axially between said first abutment means and said intermediate piston means on said drive member, at least one fluid by-pass opening being provided to permit hydraulic fluid flow within said inner annular space past said first abutment means; and second abutment means on said outer surface of said intermediate cylinder means for abutment with said end closure means on said outer cylinder on extension of said outer cylinder relative to said intermediate cylinder means, wherein said intermediate valve and conduit means has three modes of operation, a first mode wherein fluid may be supplied to said first intermediate hydraulic fluid passage means and returned via said second intermediate hydraulic fluid passage means, a second position wherein fluid may be supplied via said second intermediate hydraulic fluid passage means and returned via said first intermediate hydraulic fluid passage means, and a third position wherein no fluid may flow into or out of said first and second intermediate hydraulic fluid passage means, and wherein said outer cylinder valve means has three positions corresponding to the positions of said intermediate valve means aforesaid, whereby operation of said intermediate cylinder valve means will effect movement of only said intermediate cylinders, and whereby operation of said outer cylinder valve means will effect movement of only said outer cylinder.

2. A multistage cylinder apparatus as claimed in claim 1 wherein said intermediate cylinder means comprises at least one larger and one smaller intermediate cylinder, each being provided with a respective said end closure means and, other than a largest of said intermediate cylinders being provided with said first and second hydraulic fluid passage means and a corresponding said abutment means, the smaller intermediate cylinder being extendable and retractable with respect to the larger intermediate cylinder, and said larger intermediate cylinder being extendable and retractable within said outer cylinder, and said drive member being extendable and retractable within said smaller intermediate cylinder, including piston means on each said intermediate cylinder, and said partition means being formed adjacent said piston means on said larger intermediate cylinder.

3. A multi-stage cylinder apparatus as claimed in claim 2 and in which each said abutment means is defined by an outer diametrical locus less than the diameter of the inner surface of the next outwardly intermediate cylinder.

* * * * *